United States Patent [19]

Behling et al.

[11] Patent Number: 5,008,917

[45] Date of Patent: Apr. 16, 1991

[54] X-RAY TUBE WITH AN ELECTRON SHIELDING RIDGE ON THE CATHODE

[75] Inventors: Rolf Behling, Norderstedt; Wolfgang Köster, Hamburg, both of Fed. Rep. of Germany

[73] Assignee: U.S. Philips Corporation, New York, N.Y.

[21] Appl. No.: 433,060

[22] Filed: Nov. 6, 1989

[30] Foreign Application Priority Data

Nov. 14, 1988 [DE] Fed. Rep. of Germany ..... 3838539

[51] Int. Cl.[5] ..... H01J 35/06; H01J 5/18

[52] U.S. Cl. ..... 378/140; 378/136; 378/144; 378/145; 378/203

[58] Field of Search ..... 378/136–139, 378/144, 145, 203; 313/441, 446, 380

[56] References Cited

U.S. PATENT DOCUMENTS

| | | | |
|---|---|---|---|
| 2,107,597 | 2/1938 | Bouwers et al. . | |
| 2,926,270 | 2/1960 | Zunick | 378/144 |
| 3,250,916 | 5/1966 | Rogers | 378/134 |
| 3,549,931 | 12/1970 | DeLucia . | |
| 4,024,424 | 5/1977 | Eggelsmann et al. | 378/131 |
| 4,309,637 | 1/1982 | Fetter | 378/130 |
| 4,698,835 | 10/1987 | Ono et al. | 378/136 |

*Primary Examiner*—Edward P. Westin
*Assistant Examiner*—Kim-Kwok Chu
*Attorney, Agent, or Firm*—William Squire

[57] ABSTRACT

An anode and a cathode are in an evacuated metal envelope comprising a radiation exit window and which carry a positive and a negative high voltage, respectively, with respect thereto during operation. The cathode, at its area which neighbors the radiation exit window, has a ridge segment which extends in the axial direction partially about the cathode filament. The segment shields the radiation exit window from the electrons emitted by the cathode to reduce heating of the window by the electrons.

5 Claims, 1 Drawing Sheet

X-RAY TUBE WITH AN ELECTRON SHIELDING RIDGE ON THE CATHODE

BACKGROUND OF THE INVENTION

1. Field of the Invention

The invention relates to an X-ray tube, comprising an anode and a cathode which are arranged in an evacuated metal envelope comprising a radiation exit window and which carry a positive and a negative high voltage, respectively, with respect to the envelope during operation.

2. Description of the Prior art

An X-ray tube of this kind known from DE-PS 24 55 974 which corresponds to U.S. Pat. No. 4,024,424.

FIG. 1 shows a rotary-anode X-ray tube of this kind in a partly cut open representation. The X-ray tube comprises an evacuated tube envelope 1 which is made of metal and which is referred to hereinafter as a metal envelope, which envelope contains a disc-shaped rotary anode 2 and a cathode 3. The anode 2 and the cathode 3 are journalled and secured, respectively, in the metal envelope in a manner not shown. Journalling is realized via an insulator which is not shown. In the operating condition the anode and the cathode carry a positive and a negative high-voltage potential, respectively, with respect to the metal envelope 1 which carries ground potential.

The X-rays generated at the area of the rotary anode which faces the cathode 3 emerge through a radiation exit window 4 provided in the metal envelope 1. Radiation exit windows of this kind are comparatively thin and are preferably made of beryllium which only slightly attenuates the X-rays. Comparatively strong heating of this window occurs during operation of the X-ray tube.

SUMMARY OF THE INVENTION

It is the object of the present invention to construct an X-ray tube of the kind set forth so that the heating is reduced. This object is achieved in accordance with the invention in that at the area which neighbors the radiation exit window the cathode is provided with a ridge segment which extends in the axial direction partially about the cathode filament and which shields the radiation exit window from the electrons emitted by the cathode.

The ridge provided at the area of the cathode which faces the radiation exit window in accordance with the invention produces an electric field distribution during operation which influences the paths of the electrons emitted by the cathode so that it is substantially impossible for these electrons to reach the radiation exit window directly. Moreover, the ridge also reduces the number of electrons emitted by the cathode which are directly incident on the tube envelope or after one or more reflections, notably from the anode, so that the current flowing across the tube envelope during operation, causing a variation of the cathodes voltage in the case of a high internal resistance of the generator, is reduced.

IN THE DRAWING

The invention will be described in detail hereinafter with reference to the drawing. Therein:

DESCRIPTION OF THE PREFERRED EMBODIMENT

Figure 1:
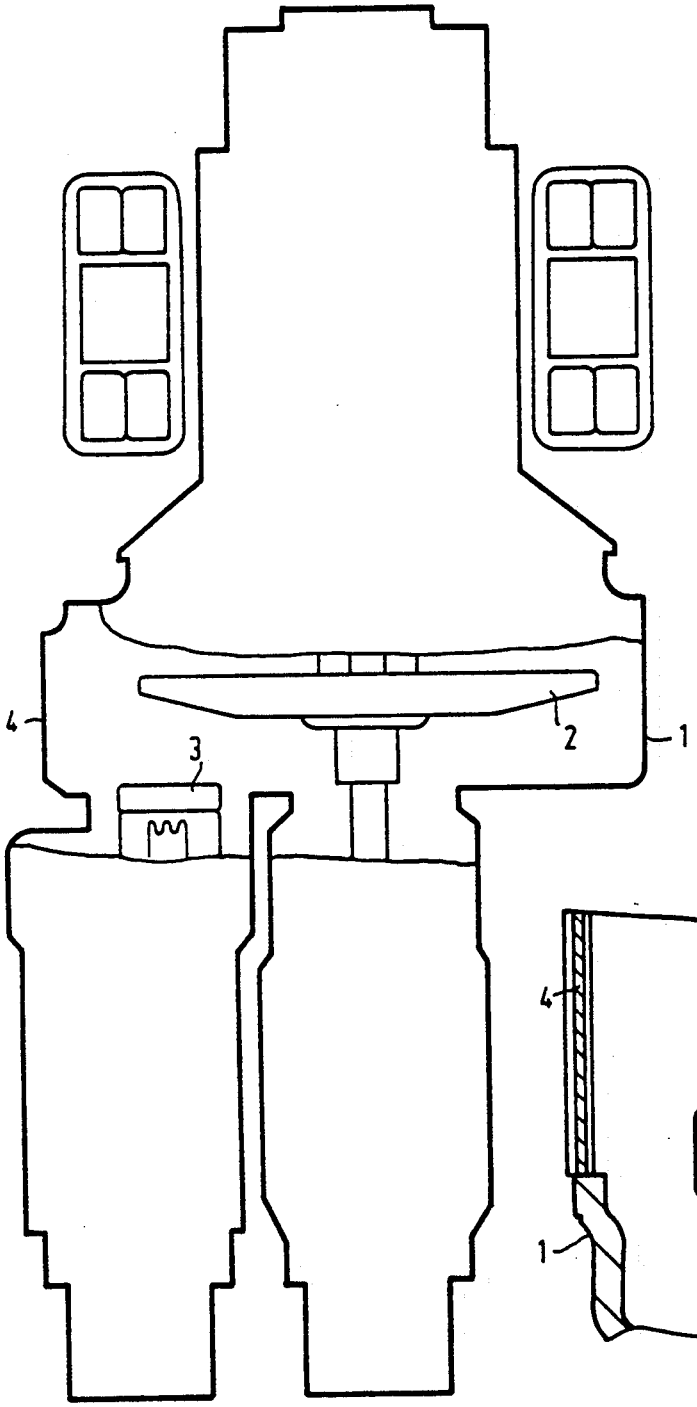
FIG. 1 is a diagrammatic view of the known X-ray tube.
Figure 2:
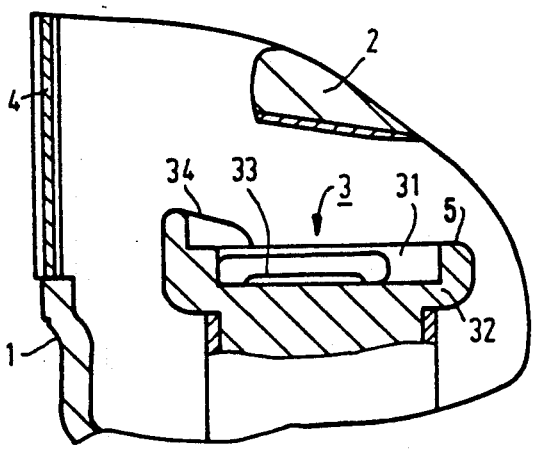
FIG. 2 shows a detail of an X-ray tube in accordance with the invention.

FIG. 2 shows the cathode of a so-called double-focus X-ray tube, that is to say an X-ray tube which comprises two adjacently arranged filaments whose longitudinal direction extends approximately perpendicularly to the radiation exit window. The two filaments (not shown) are accomodated in stepped recesses (cut-outs) which are inclined towards one another. The two recesses, only the rear recess 31 being shown in the drawing, are separated from one another by a connecting portion 32 which also masks the filament present in the lower part 33 of the recess 31 in the cross-sectional representation.

On the cathode 3 end face rims which faces the rotary anode 2 and which is situated in a plane perpendicular to the axis of rotation of the rotary anode there is provided a ridge 34 which extends in the axial direction toward the anode 2 and is shaped as a segment of arc extending about the filament. The ridge 34 is in the area neighbouring the radiation exit window 4 between the window 4 and the filaments in the recess 31 and recess not shown. The ridge 34 extends in the axial direction and covers an arc of approximately 90°; it has a thickness of 3 mm and its maximum height amounts to 4 mm (FIG. 2 is not to scale). As a result, the field around the cathode head (i.e. the part of the cathode facing the anode) is influenced so that the electrons emerging from the lower part 33 of the recess are laterally deflected (to the right), after which they strike the anode. Evidently, the filament or the recess must be shaped so that the electrons are incident on the desired area of the anode under the influence of the deflection caused by the ridge 34.

The ridge 34 substantially prevents the electrons emitted by the cathode from being directly incident on the window. Only electrons reflected by the anode 2 will still be incident on the radiation exit window. The reduction of the number (and partly also the energy) of electrons incident on the radiation exit windows also reduces the heating thereof. Moreover, the ridge ensures that fewer electrons can reach the metal envelope of the X-ray tube. This results in a reduction of the undesirable current across the metal envelope of the X-ray tube.

The invention has been described with reference to a rotary-anode X-ray tube; however, it can also be used for X-ray tubes comprising a stationary anode.

What is claimed is:

1. An X-ray tube construction comprising:

an evacuated metal envelope, said envelope including a radiation exit window; and an anode and cathode in the envelope in spaced relation at respective positive and negative voltages for generating X-rays;

said cathode comprising a filament located in a recess in the cathode, said cathode having a rim defining the recess, said rim extending toward said anode in a given axial direction, said window being positioned transverse said axial direction adjacent to said cathode, said cathode emitting electrons toward said anode, said cathode including a ridge segment extending partially about said filament, said segment being on said rim at a region between said filament and said window and extending in the axial direction an amount sufficient for shielding the window from direct incidence of electrons emitted by said cathode.

2. The construction of claim 1 wherein said segment is arcuate.

3. The construction of claim 2 wherein said segment extends about 90° in a plane transverse said axial direction.

4. The construction of claim 1 wherein said tube includes means for rotating the anode.

5. The construction of claim 1 wherein said segment has a thickness of about 3 mm and a maximum height in said axial direction of about 4 mm.

* * * * *